United States Patent [19]

Hadley et al.

[11] Patent Number: 4,824,352

[45] Date of Patent: Apr. 25, 1989

[54] APPARATUS FOR PELLETIZING MATERIALS

[76] Inventors: Richard S. Hadley, 6310 Talmadge Rd., Independence, Oreg. 97351; Kenneth A. Cade, P.O. Box 368, Boardman, Oreg. 97818

[21] Appl. No.: 109,936

[22] Filed: Oct. 16, 1987

[51] Int. Cl.[4] ..... B30B 11/28

[52] U.S. Cl. ..... 425/168; 264/142; 425/294; 425/331; 425/DIG. 230

[58] Field of Search ..... 264/141, 142; 425/294, 425/331, 168, 335, 363, 365, DIG. 230, 310, 314

[56] References Cited

U.S. PATENT DOCUMENTS

| | | | |
|---|---|---|---|
| 1,127,925 | 2/1915 | Schueler | 425/331 |
| 1,467,883 | 9/1923 | Sizer | 425/331 |
| 2,782,736 | 2/1957 | Johnson | 425/331 |
| 3,063,361 | 11/1962 | Gehrke | 425/DIG. 230 |
| 3,101,510 | 8/1963 | Packham | 425/331 |
| 3,234,894 | 2/1966 | Dechert | 425/331 |
| 3,312,530 | 4/1967 | Sackett | 425/DIG. 230 |
| 3,327,653 | 6/1967 | Crane | 425/DIG. 230 |
| 3,743,462 | 7/1973 | Alessio | 425/331 |
| 3,781,151 | 12/1973 | Harris | 425/222 |
| 3,859,026 | 1/1975 | Osborn | 425/DIG. 230 |
| 3,962,462 | 6/1976 | Burkwall, Jr. et al. | 426/1 |
| 4,017,241 | 4/1977 | Papinchak et al. | 425/237 |
| 4,022,562 | 5/1977 | Spencer | 425/331 |
| 4,552,567 | 11/1985 | Nielsen | 425/DIG. 230 |

FOREIGN PATENT DOCUMENTS

| | | | |
|---|---|---|---|
| 0143414 | 6/1985 | European Pat. Off. | 425/331 |
| 59-199198 | 11/1984 | Japan | 425/331 |
| 61-279400 | 12/1986 | Japan | 425/294 |
| 703063 | 12/1979 | U.S.S.R. | 425/DIG. 230 |
| 8404276 | 11/1984 | World Int. Prop. O. | 425/331 |

*Primary Examiner*—Jay H. Woo
*Assistant Examiner*—James C. Housel
*Attorney, Agent, or Firm*—Stoel Rives Boley Jones & Grey

[57] ABSTRACT

In accordance with the subject invention an apparatus is provided which is capable of directly pelletizing a non-particularized material without substantially destroying the fibrous nature of the material during pellet formation. The apparatus comprises a pair of horizontally-extending cylindrical dies, mounted in parallel planar relation for rotation in opposite directions. The dies are spaced closely apart to form a finely spaced intermeshing nip therebetween, for compressively pelletizing the nonparticularized material. The dies are rotated at a predetermined rate of rotation. Each die includes a horizontally-extending hollow central interior chamber for receiving the compacted pellets. Passageways radially-extend from the hollow central interior chamber to the outer circumference of the dies. Teeth are arranged on the dies for cutting the material into selective non-particularized lengths and, immediately thereafter, for compressively moving the cut material from within the nip, through the passageways, and into the hollow central interior chamber.

5 Claims, 2 Drawing Sheets

APPARATUS FOR PELLETIZING MATERIALS

BACKGROUND OF THE INVENTION

This invention relates to an apparatus and to a method for pelletizing materials.

Various apparatus for pelletizing particulate materials are known. In U.S. Pat. Nos. 3,781,151 and 4,017,241, agglomerating novel feeding devices for producing charcoal briquettes by feeding such particulate material between a pair of compacting rolls having a plurality of circumferentiallyspaced formation pockets for peripherially forming such briquette composite structures. Although such a peripheral compaction process can be employed for converting particulate material to its agglomerated form using the above compaction apparatus, it cannot be readily used on material which has not been previously particularized, and in many cases without the introduction of binder agents for adhering the particulate material. Another apparatus is described in U.S. Pat. No. 4,022,562 for pelletizing material, which has been previously particularized, to form cattle feed and the like. In this case the starting material is introduced into the interior of an annular die, commonly known as a California pellet mill. The pelletizable material requires particularization prior to such introduction. This results in costly additional processing steps prior to pelletizing and eliminates substantial fiber length and fiber identity. The feed material, in any case, is then milled into a pulverized form using fixed internally mounted pressure rollers which crush the material as the annular die is rotated thereabout. This pulverized material is then extruded through bores in the annular die housing. In commercial use, adhesive binders are typically added to the pulverized material if pellets of any substantial size are to be produced which are capable of retaining their structural integrity. In U.S. Pat. No. 3,962,462, particularized ingredients in the form of a semi-moist dough-like material is extruded through a die onto a conveyor and then dried in an oven.

In many uses there is a need for high fiber length pellets. An example of such a situation is when animal feed pellets are formed from fibers such as straw and alfalfa, particularly coarse fibers, instead of particularized materials. These materials can be more readily digested in long fiber pellet form, resulting in the formation of more nutrients in the animal's stomach. However, pellets of any substantial fiber length size cannot be directly made by known pelletizing methods. There are also materials which are not directly conventionally pelletizable at ambient conditions, such as whole wood fibers, cellulosic papermaking fibers, and even polymeric materials such as plastics and the like.

Therefore, a need exists for a system which will directly pelletize coarse fibers, long fiber materials, and even particularized fibers and materials, which is not costly and time consuming to operate, and which will directly produce a highly fibrous end product for animal use and the like. Additionally, a further need exists for a system which will directly pelletize materials such as wood and cellulosic fibers, polymers, and the like.

SUMMARY OF THE INVENTION

The subject invention is directed to an apparatus and a method for directly pelletizing a pelletizable material, without substantial prior particularization, and without requiring the addition of binder agents--both of which are costly and time consuming. Instead, the apparatus and method of the present invention can directly pelletize coarse fiber and long fiber materials, such as straw and alfalfa, into a fibrous end product of extremely high fiber content for use in applications such as the animal feed industry. Moreover, materials not readily conventionally pelletizable, particularly by direct pelletizing techniques, such as whole wood fibers, papermaking fibers, newsprint fibers, and polymeric materials, can be pelletized by the apparatus and method of this invention.

In accordance with the subject invention, an apparatus is provided which is capable of directly pelletizing a nonparticularized material without substantially destroying the fibrous nature of the material during pellet formation. The apparatus comprises a pair of horizontally-extending die means, mounted in parallel planar relation for rotation in opposite directions. The die means are spaced closely apart to form a closely spaced intermeshing nip therebetween, for compressively pelletizing the nonparticularized material. Means are provided for synchronously rotating each of die means at a predetermined rate of rotation. This can be done by rotating one of the die means so that it drives the second die means by the synchronous action imparted to the second die means at the intermeshing nip. However, the synchronous action is accomplished typically by opposedly rotating each of the die means. The die means are preferably hydraulically driven with a constant torque being applied to at least one, and more preferably both, pair of the die means. It is also preferred that the die means are each rotated at substantially the same predetermined rate of rotation.

At least one of the die means comprises means defining a horizontally-extending hollow central interior receiving chamber for delivering the compacted pellets thereto. Means defining a plurality of circumferentially spaced passageways, in at least one of the pair of die means, radially extend from the hollow central interior chamber to the outer circumference of the die means. The passageways have a predetermined configuration depending on the density, moisture, and fiber length of the material being pelletized. The passageways preferably have a cylindrical or tapered configuration, or a combination thereof. The extent of the taper, and the length and width of the passageway controls to a great extent the density and the extent of compaction of the final pelletized product.

Circumferentially arranged on the die means is a means for cutting the material into selective nonparticularized lengths and, immediately thereafter, for compressively moving the cut material from within the nip, through the passageways, and into the hollow central interior chamber. In this way, compacted pellets of the material of a predetermined configuration are formed.

In the design of the apparatus each of the die means is preferably substantially cylindrically shaped. Furthermore, each of the means for cutting and compressively moving the material typically comprises a plurality of radially-extending protuberances circumferentially spaced on the outer circumference of each of the die means. The plurality of protuberances preferably comprise complementary intermeshing gear-like teeth. The die means preferably includes means defining a recessed portion comprising a floor section joined to a pair of sidewall sections. The recessed portion is generally formed between respective circumferentially-spaced protuberances on each of the die means. The passageways can then be arranged in axially-extending rows in the floor of each recessed portion. In a preferred configuration of the present invention, the protuberances on each die means are shaped so that, at the nip, the respective circumferential surfaces of the die means are intermeshing, the protuberance on one of the die means and the recessed portion on the other die being circumferentially complementary with each other for intermeshing engagement thereof. Furthermore, it is preferred that one of the die means has at least one more means for cutting and compressively moving the pelletizable material than the other die means.

The passageways of the subject apparatus are generally either cylindrical or tapered in configuration, preferably a combination of tapered and cylindrical in configuration. A prefer form of the tapered configuration is a taper having a constantly inwardly decreasing diameter with the diameter of each passageway at the outer surface of the die means being greater than the diameter of the passageway at the interior hollow portion.

The protuberances of the die means are typically tapered in shape, and are preferably tapered at a constantly increasing cross-sectional area with the cross-sectional area of each protuberance at its outer end being less than the cross-sectional area of each protuberance at its inner end.

The foregoing and other objects, features and advantages of the invention will become more readily apparent from the following detailed description of a preferred embodiment which proceeds with reference to the drawings.

DETAILED DESCRIPTION OF THE DRAWINGS

DETAILED DESCRIPTION OF INVENTION

Figure 1:
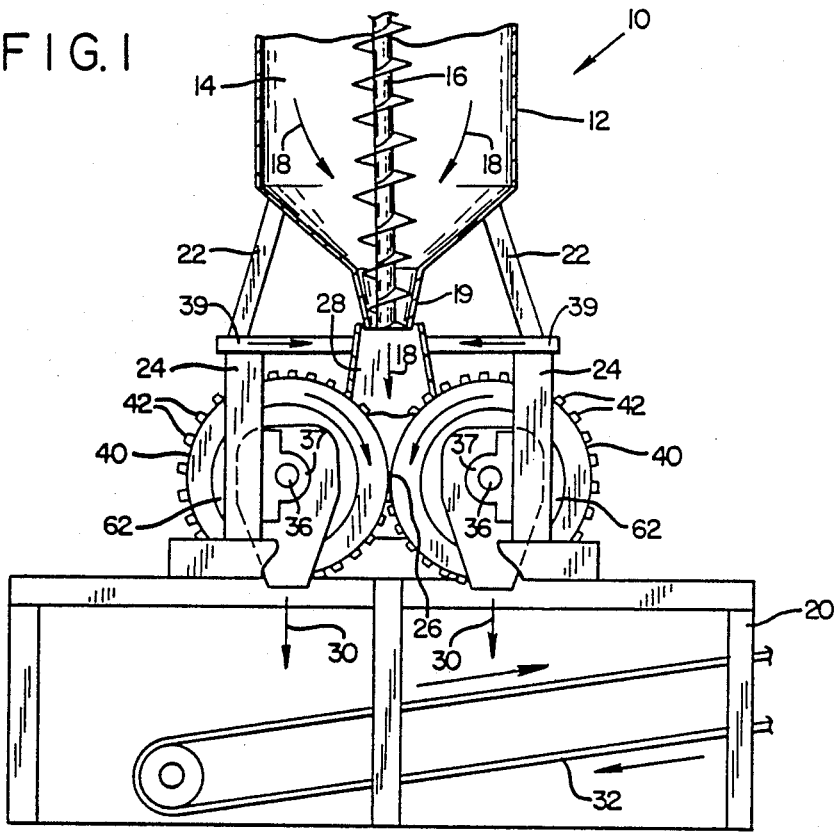
FIG. 1 is a partially-sectional, elevational view of the pelletizing system of the present invention.

Referring now to FIG. 1, an apparatus 10 is depicted for directly pelletizing a pelletizable material 14.

The material can include such diverse materials as alfalfa, straw, newsprint, cellulosic fiber-containing materials, wood fiber-containing materials, polymeric materials and the like.

The material is fed to an infeed hopper 12, having been transported from a remote source of storage by an infeed duct system (not shown). The material 14 is moved through infeed hopper 12 by a vertical screw mechanism 16, in the form of a tapered flighting auger, mounted within the confines of infeed hopper 12. The infeed hopper 12 includes a hopper outlet leg 19 into which the vertical screw mechanism 16 extends for more effective transportation of material 14 therethrough.

Apparatus 10 is supported above ground level by a base support frame 20, and infeed hopper 12 is supported thereon by a hopper support frame 22. A pair of cylindrical dies, hereafter referred to as die means 40, are mounted on parallel, horizontal shafts 36 for rotation in opposite directions. The die means 40 are supported on support frame 24 directly below infeed hopper 12. Die means 40, which are spaced closely apart one from the other to form an intermeshing nip 26 therebetween, compressively moves the material 14 through passageways 44 to produce the pellets. A flat belt conveyor 32 located below the pair of die means 40 receives the pellets, after they are produced by such pair of die means 40, and transports the pellets to a remote storage or packaging area (not shown).

The material 14 is moved through infeed hopper 12 by vertical screw mechanism 16 out of hopper outlet leg 19 and into an outlet conduit 28, pursuant to the flow directional arrows 18. The outlet conduit 28 directs the flow of exiting material 14 into a nip 26. The material 14 is compressingly pelletized by the pair of die means 40 and moves out of the respective die means 40, pursuant to directional arrows 30, onto conveyor 32 and then to a remote location (not shown).

Figure 2:
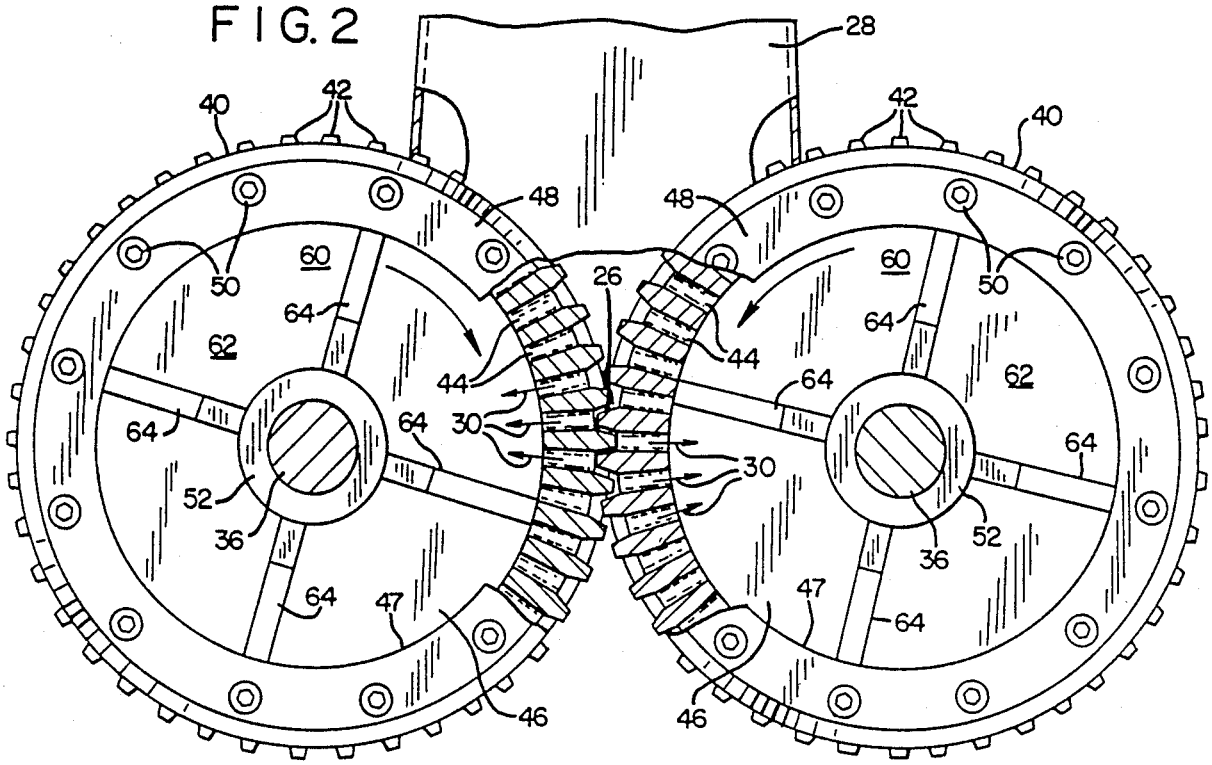
FIG. 2 is an enlarged, fragmentary, partially-sectional, rear view of a pair of die means 40 as depicted in FIG. 1.
Figure 3:
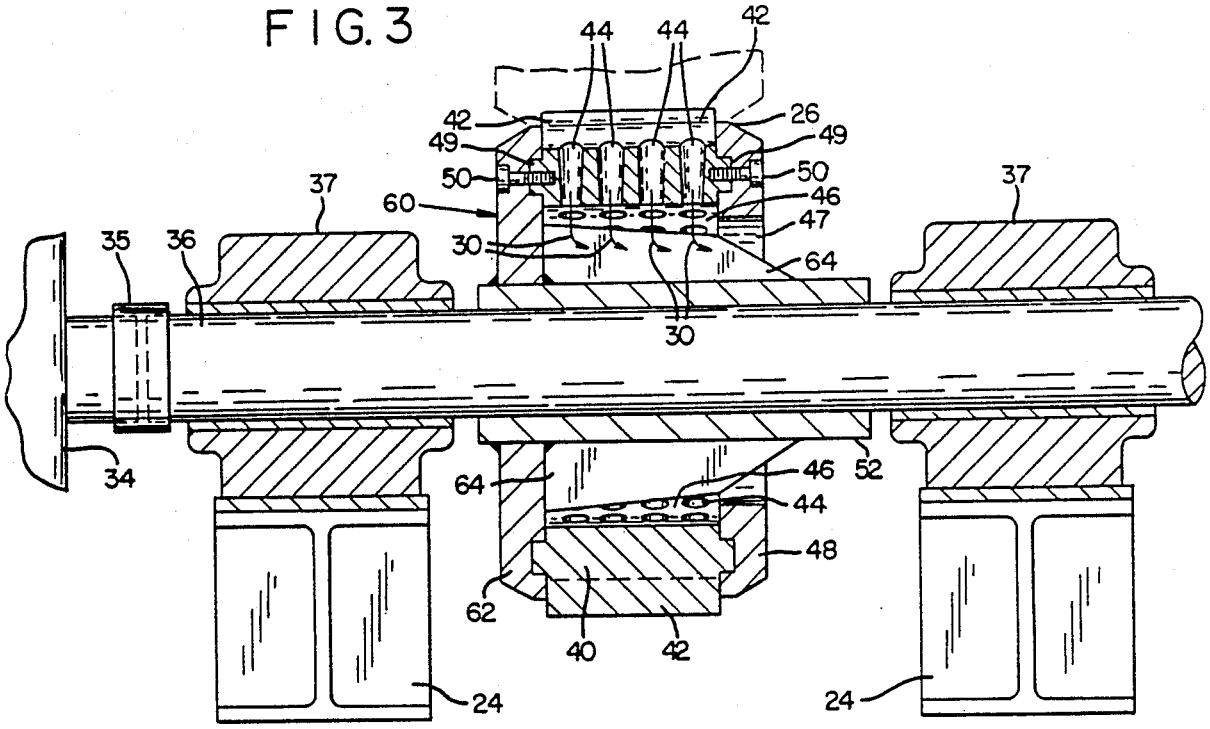
FIG. 3 is an enlarged, fragmentary, crossssectional plan view of one of the die means, further including the means for rotating and for supporting die means 40.
Figure 4:
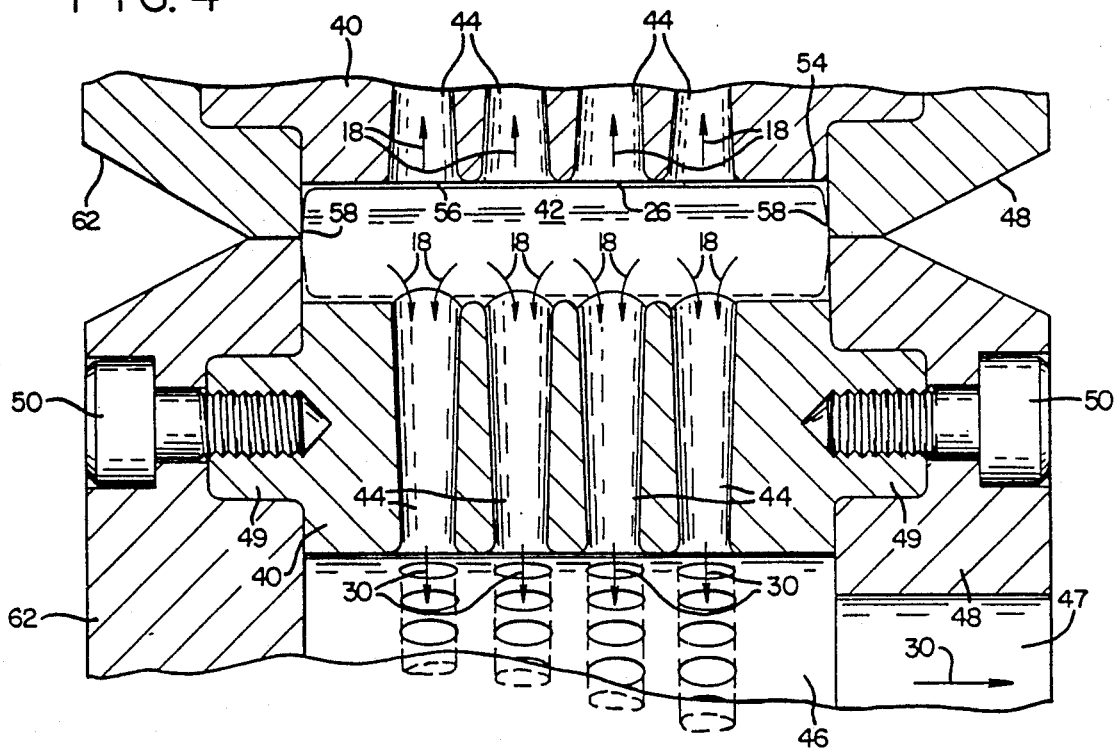
FIG. 4 is an enlarged, fragmentary, cross-sectional plan view of a portion of a pair of die means 40 depicting the intermeshing nip formed therebetween.

Referring now to FIGS. 2–4, the pair of horizontally-extending die means 40 are journaled on shaft 36 for opposed rotational movement pursuant to the directional arrows in FIGS. 1 and 2 and in turn shaft 36 is mounted on pillow block bearings 37. Die means 40 are opposedly, synchronously rotated in a predetermined rate of rotation by hydraulic motors 34 connected via coupling sleeves 35 to the ends of shafts 36. Alternatively, a single hydraulic motor 34 can be provided to one of the die means 40 to synchronously die both drive means 40. Hydraulic motors 34 provide a means for constantly and substantially equally applying torque to each of the die means 40. This application of constant, substantial equal torque is facilitated by torque absorbing arms for the hydraulic motors 34 connected to shafts 36 and shaft bearings 37, respectively. This torque is applied by hydraulic motors 34 through shaft bearing 37. The hydraulic motors 34 are synchronously driven by a hydraulic power pack system (not shown) including a hydraulic pump to a hydraulic fluid reservoir and to a multi-positioned hydraulic valve, the hydraulic valve is in communication with both of the hydraulic motors. A pressure relief system back to the reservoir can be provided from between the valve and the motors. In this system, substantially equalized pressure is provided to both motors 34 from the hydraulic pump so in turn the pair of die means 40 are synchronously driven at substantially the same rate of rotation. In order to maintain die means 40 in aligned relationship when substantial torque is applied to the material 14 at the nip 26, counter-rotational torque arms 39 (see FIG. 1) are bolted to either end of support frame 24.

Die means 40 each include means defining a horizontally-extending hollow central interior chamber 46. After the pellets are formed, they flow through hollow chambers 46 and the openings 47 located therein onto conveyor 32. Openings 47 are formed within the area surrounded by rings 48 which are joined to one end of die means 40 by bolts 50. Drive rings 48 provided rigid support for maintaining the cylindrical integrity of die means 40. Circular wall assemblies 60 are joined to the other end of die means 40 by bolts 50. The wall assembly 60 includes axially-extending support hubs 52 which are disposed for journaled connection of said die means 40 to shafts 36. Hubs 52 are held in axially-extending position by support gussets 64 welded to the hubs and to circular walls 62. Die means 40 also include die attachment flanges 49 which facilitate the structural connection of respective circular wall assemblies 60 and drive ring 48 by bolts 50 to die means 40.

Means defining a plurality of circumferentially spaced passageways 44 having a predetermined taperedcylindrical configuration radially extend from the hollow central interior chamber 46 to the outer circumference of die means 40. Passageways 44 are located in both die means 40 but could be provided in only one of said die means 40 if so desired. If passageways 44 are provided in one die means 40, the second die means need not have a hollow chamber 46.

Passageways 44 are tapered at the inlet side and cylindrical at the outlet side of die means 40, although a totally cylindrical or totally tapered passageway may be employed. The respective axial lengths and the inlet and outlet diameters of passageways 44 can be varied depending on the nature of the material 14 to be pelletized. The axial length of the passageways will preferably be from about 2" to about 8", and more preferably from about 3" to about 5". Moreover, the inlet diameter will preferably vary from about 0.5" to about 1.25" and more preferably from about 5/8" to about 1", and the outlet diameter will preferably vary from about ⅜" to about 1", and more preferably from about ⅝" to about ¾". The diameter of the pellets produced will preferably range from about ⅜" to about 1", and more preferably from about ½" to about ¾", and the length of the pellets produced will preferably range from about ¼" to about 10", and more preferably from about ½" to about 6".

Intermeshing teeth 42 are arranged circumferentially on die means 40 for cutting material 14 into selected nonparticularized lengths and, immediately thereafter, for compressively moving the cut material from within nip 26, through passageways 44, to form pellets of material 14 of a predetermined configuration. The die means 40 are substantially cylindrically-shaped.

Teeth 42 extend axially across the circumference of die means 40, extend radially from the outer circumference of die means 40 and are circumferentially spaced on the outer circumference of die means 40, respectively. Teeth 42 have a trapezoidal axial cross-sectional configuration. Die means 40 also includes means defining recessed portions 54 which are formed between respective teeth 42 on each die means 40. The recessed portion comprises a floor section 56 and a pair of sidewalls 58. Passageways 44 are arranged in axially-extending rows in the floor section 56. The teeth 42 on each die means 40 are shaped so that, at the nip 26, the circumferential surface of the die means 40 will intermesh. Thus, the teeth 42 on one of the die means 40 and the recessed portion 54 on the other die means 44 are circumferentially complementary with each other for intermeshing engagement thereof. Moreover, the teeth are also tapered at a constantly-increasing cross-sectional area, the cross-sectional area in each tooth at its outer end being less than the cross-sectional area of each tooth at its inner end.

The number of teeth 42 on one die means 40 is preferably different than the number of teeth 42 on the second die means 40. Generally, the number of teeth on the first die means is one less than the number of teeth on the second die means. This results in the intermeshing action at the nip taking place between different teeth and recess means on each successive die means revolution. In this way, the respective die means 40 have a longer useful life.

Having illustrated and described the principles of our invention in a preferred embodiment thereof, it should be readily apparent to those skilled in the art that the invention can be modified in arrangement and detail without departing from such principles. We claim all modifications coming within the spirit and scope of the accompanying claims.

We claim:

1. A pelletizing apparatus comprising:

(a) a first cylindrical die having a plurality of circumferentally spaced apart teeth formed to protrude radially outwardly therefrom;

(b) a second cylindrical die having a plurality of circumferentially spaced apart teeth formed to protrude radially outwardly therefrom, the number of teeth formed in the second die belong fewer than the number of teeth formed in the first die, each die having a row of discrete passageways formed between adjacent teeth, each passageway extending radially through the die and having a radially outer end and a radially inner end, the inner end terminating in an interior chamber that is formed within the die; and (c) drive means for rotating the first and second dies about parallel axes of rotation so that the teeth of both dies mesh.

2. The apparatus of claim 1 wherein the second die has one tooth less than the first die.

3. The apparatus of claim 2 wherein each passageway has an inwardly tapered diameter portion at the outer end thereof and a contiguous constant diameter portion at the inner end, and wherein each tooth on the first and second dies is formed so that its cross-sectional area gradually decreases in the radially outward direction.

4. The apparatus of claim 3 wherein the drive means includes:

(a) a shaft extending through each die, the ends of the shafts being carried in bearings that are mounted to a frame;

(b) a first annular member mounted to one axial end of each die and a second annular member mounted to the other axial end of each die, the first and second annular members projecting radially from the rotational axes of the dies to define between each adjacent pair of teeth the end walls of a recess, each recess of one die configured for receiving the radially outermost portion of a tooth on the other die as the die teeth mesh;

(c) a hub assembly connected to the shaft and to one of the annular members for transmitting rotation of the shaft to the associated die; and (d) an arm fixed to the frame member to prohibit movement of the shafts away from each other.

5. A pelletizing apparatus comprising:

(a) a first cylindrical die having a plurality of circumferentially spaced apart teeth formed to protrude radially outwardly therefrom;

(b) a second cylindrical die having a plurality of circumferentially spaced apart teeth formed to protrude radially outwardly therefrom, each die having a row of discrete passageways extending radially through the die between adjacent teeth, each die being mounted about a rotatable shaft, one die having fewer teeth than the other;

(c) a first annular member mounted to one axial end of each die and a second annular member mounted to the other axial end of each die, the first and second annular members projecting radially outwardly to define between each adjacent pair of teeth the end walls of a recess, each recess of one die configured for receiving the radially outermost portion of a tooth on the other die;

(d) a hub assembly connected to the shaft and to one of the annular members for transmitting rotational motion of the shaft to the associated die; and (e) drive means for rotating the first and second shaft so that their respective teeth mesh.

* * * * *

UNITED STATES PATENT AND TRADEMARK OFFICE

CERTIFICATE OF CORRECTION

PATENT NO. : 4,824,352

DATED : April 25, 1989

INVENTOR(S) : Richard S. Hadley and Kenneth A. Cade

It is certified that error appears in the above-identified patent and that said Letters Patent is hereby corrected as shown below:

Column 1, line 5, "and to a method" should be deleted.

Column 1, line 9, after "agglomerating" insert --apparatuses are provided from--.

Column 1, line 12, insert "-" between circumferentiallyspaced.

Column 5, line 5, insert "-" between taperedcylindrical.

Column 6, line 14, "belong" should be --being--.

Signed and Sealed this

Sixteenth Day of January, 1990

*Attest:*

JEFFREY M. SAMUELS

*Attesting Officer* *Acting Commissioner of Patents and Trademarks*